US011032638B2

(12) United States Patent
Cheung et al.

(10) Patent No.: US 11,032,638 B2
(45) Date of Patent: Jun. 8, 2021

(54) SPEAKER WITH AN INTEGRATED AIR PRESSURE AND VIBRATION MITIGATION SYSTEM

(71) Applicants: Ngai Fun Cheung, Hong Kong (HK); Yiu Hung Yeung, Hong Kong (HK)

(72) Inventors: Ngai Fun Cheung, Hong Kong (HK); Yiu Hung Yeung, Hong Kong (HK)

( * ) Notice: Subject to any disclaimer, the term of this patent is extended or adjusted under 35 U.S.C. 154(b) by 0 days.

(21) Appl. No.: 16/786,735

(22) Filed: Feb. 10, 2020

(65) Prior Publication Data

US 2021/0021926 A1 Jan. 21, 2021

Related U.S. Application Data

(60) Provisional application No. 62/874,801, filed on Jul. 16, 2019.

(51) Int. Cl.
*H04R 1/28* (2006.01)
*H04R 1/02* (2006.01)

(52) U.S. Cl.
CPC ..... *H04R 1/288* (2013.01); *H04R 1/025* (2013.01)

(58) Field of Classification Search
None
See application file for complete search history.

(56) References Cited

U.S. PATENT DOCUMENTS 3,798,393 A * 3/1974 Gorike ..... H04R 1/1008 381/372
5,469,505 A * 11/1995 Gattey ..... H04M 1/05 379/430
7,324,655 B2 * 1/2008 Sato ..... B06B 1/045 381/151
9,351,075 B2 5/2016 Kunimoto
9,800,978 B2 * 10/2017 Noertker ..... H04R 1/1008
2014/0056459 A1 * 2/2014 Oishi ..... H04R 1/10 381/370
2015/0264470 A1 * 9/2015 Li ..... H04R 1/1091 381/378
2019/0052966 A1 * 2/2019 Hara ..... H04R 29/001
2019/0189106 A1 * 6/2019 Hull ..... H04R 19/04

FOREIGN PATENT DOCUMENTS

CN 202979242 U 6/2013
CN 204425583 U 6/2015
EP 2701400 B1 4/2018
WO WO2014056448 A1 10/2013

* cited by examiner

*Primary Examiner* — Paul W Huber

(57) ABSTRACT

A speaker with an integrated air pressure and vibration mitigation system is used to produce high fidelity acoustic and vibratory output. The speaker has a main cabinet a set of ventilation holes, an acoustic driver, a vibration unit, and a dampening unit. The main cabinet is an enclosure that retains the acoustic driver, the vibration unit and the dampening unit in desired orientations. The ventilation holes traverse through the main cabinet and provide exhaust ports for unwanted air pressure force and vibrations to be expelled into the external environment. The acoustic driver is mounted to a first face of the main cabinet. The dampening unit is a filter that is mounted in between the vibration unit and the main housing and prevents the transmission of unwanted vibrations and air pressure between the vibration unit and the acoustic driver. Thus, the acoustic driver can oscillate without hinderance and produce distortion-free audio.

13 Claims, 8 Drawing Sheets

SPEAKER WITH AN INTEGRATED AIR PRESSURE AND VIBRATION MITIGATION SYSTEM

The current application claims a priority to the U.S. Provisional Patent application Ser. No. 62/874,801 filed on Jul. 16, 2018.

FIELD OF THE INVENTION

The present invention relates generally to speaker systems. More specifically, the present invention relates to a ventilated speaker system that uses a vibration unit to produce haptic feedback while reducing audio distortion by exhausting excess air pressure force into the ambient environment.

BACKGROUND OF THE INVENTION

Throughout history, humans have always found methods of entertaining themselves. These methods are as varied as the stars in the sky, and range from storytelling to full-on virtual reality environments. What has remained consistent, however, is that humans employ contemporary technology to further enhance entertaining experiences. In the case of virtual reality, for example, a user dons a headset that blocks out the external environment and immerses the user into a computer-generated reality. Unfortunately, this reality is only as immersive as the technology used to support it and relies upon effective audio and visual output systems. One means of further immersing the user, is to provide haptic feedback that corresponds to events within the virtual environment. Traditional systems use vibrating devices that are advantageously placed to achieve this effect. Some systems integrate vibrating devices into speaker systems. This is a good way to save space but often introduces distortions into the audio output of the speaker. Operating an acoustic driver and a vibration unit within a closed housing causes the air pressure force generated by oscillations of the vibrating device and the diaphragm of the acoustic driver to create a high-pressure environment. This high-pressure environment hinders the ability of the diaphragm to oscillate freely. Thus, introducing audio distortions which detract from the immersive experience, and thus reduce overall entertainment value.

The present invention addresses the issue of audio distortions for speakers with integrated haptic feedback systems. To achieve this functionality, the present invention is designed to provide a speaker system that uses a ventilated cabinet to transport unwanted air pressure force away from the diaphragm of the audio driver. The transport vents enable the diaphragm to oscillate freely. Thereby minimizing audio distortions. The present inventio further employs a multi-compartment enclosure. This configuration enables a partition plate to be placed in between the compartment housing the acoustic drive and the compartment housing the vibrating device. By separating the two components, the present invention further reduces audio distortion caused by interactions between the acoustic driver and the vibrating device.

DETAIL DESCRIPTIONS OF THE INVENTION

Figure 1:
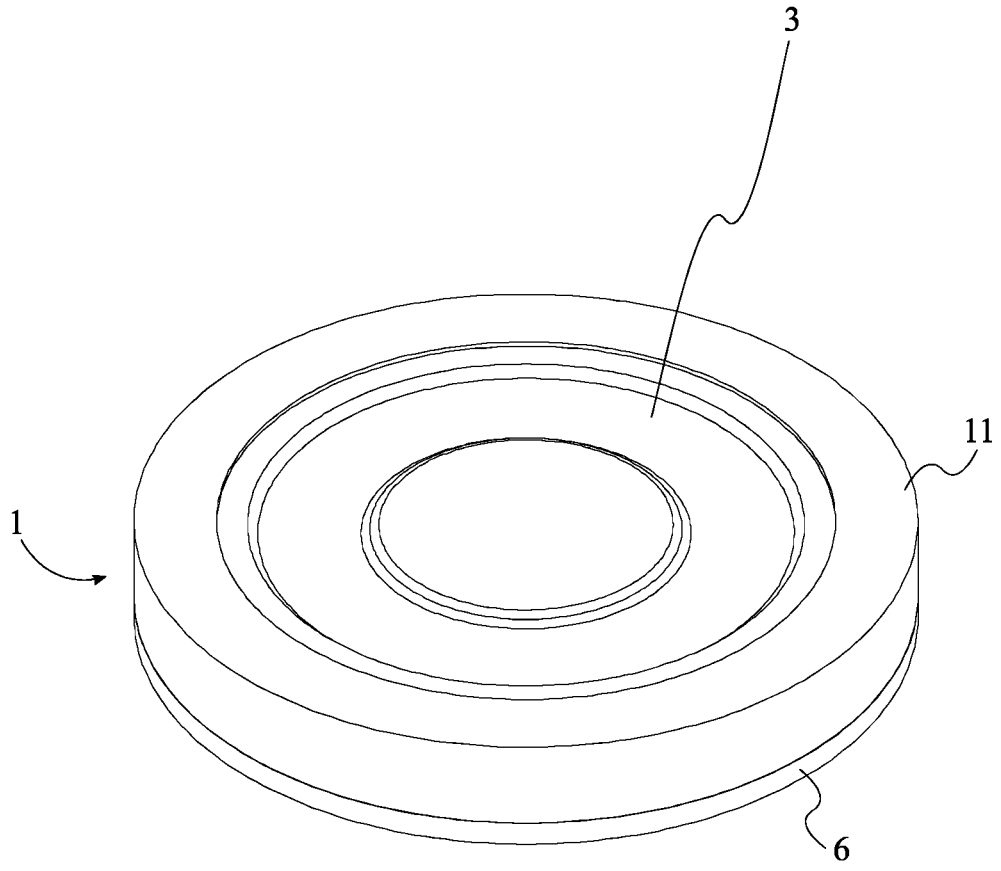
FIG. 1 is a top perspective view of the present invention.
Figure 2:
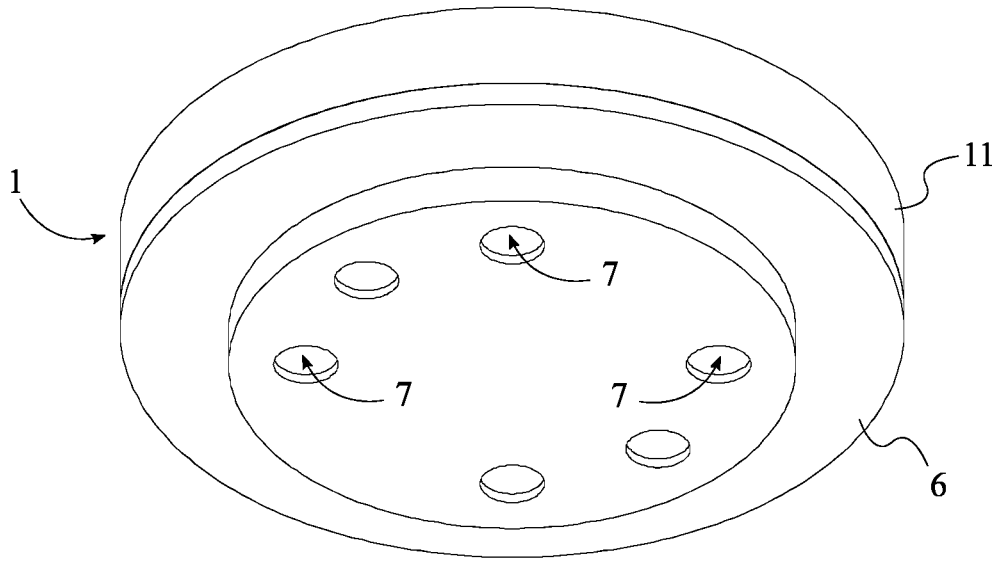
FIG. 2 is a bottom isometric perspective view of the present invention.

All illustrations of the drawings are for the purpose of describing selected versions of the present invention and are not intended to limit the scope of the present invention.

In reference to FIG. 1 through FIG. 8, the present invention is a speaker with an integrated air pressure force and vibration mitigation system that makes use of airflow channels that act as exhaust vents for any air pressure force generated by acoustic drivers and vibration units. Specifically, the present invention is a speaker device that makes use of a vented cabinet system to retain an acoustic driver and a vibration unit in separate compartments, thereby reducing audio distortion for the acoustic driver. Further, the present invention makes use of the vented cabinet to exhaust the air pressure force generated by the acoustic driver and the vibration unit. Thereby, preventing excess air pressure force from hindering the motion of the acoustic driver's diaphragm and reducing audio distortion. Preferably, the acoustic driver operates at a frequency range from 20 Hz to 20 KHz and the vibration unit operates at a frequency range of 20 Hz to 6 KHz. To achieve this functionality, the present invention comprises a main cabinet 1, a plurality of main ventilation holes 2, at least one acoustic driver 3, at least one vibration unit 4, and at least one primary dampening unit 5. The main cabinet 1 is a housing that retains the components of the present invention is a desired orientation. The vibration unit 4 is preferably a vibrator disk that enables the present invention to produce haptic feedback. The plurality of main ventilation holes 2 traverses through the main cabinet 1. Thus, forming a plurality of vents that enable the air pressure force and vibrations generated by the vibration unit 4 and the acoustic driver 3 to be advantageously transported through the main cabinet 1. Preferably, desirable air pressure force and vibrations are directed toward a desired position while unwanted air pressure force and vibrations are expelled into the surrounding environment through the plurality of main ventilation holes 2. Specifically, the plurality of main ventilation holes 2 functions as a filter that winnows out unwanted air pressure force, thereby minimizing audio distortions. The acoustic driver 3 is mounted adjacent to the main cabinet 1 and the vibration unit 4 is mounted adjacent to the main cabinet 1, opposite to the acoustic driver 3. Accordingly, the main cabinet 1 maintains the acoustic driver 3 and the vibration unit 4 in a configuration that facilitate directing the audio and vibratory output of the present invention toward a desired position. Preferably, the vibration unit 4 and the acoustic driver 3 are concentrically aligned and mated to an external cabinet with an adhesive. Consequently, the maximum amount of acoustic and vibratory output is transferred to a user.

Figure 5:
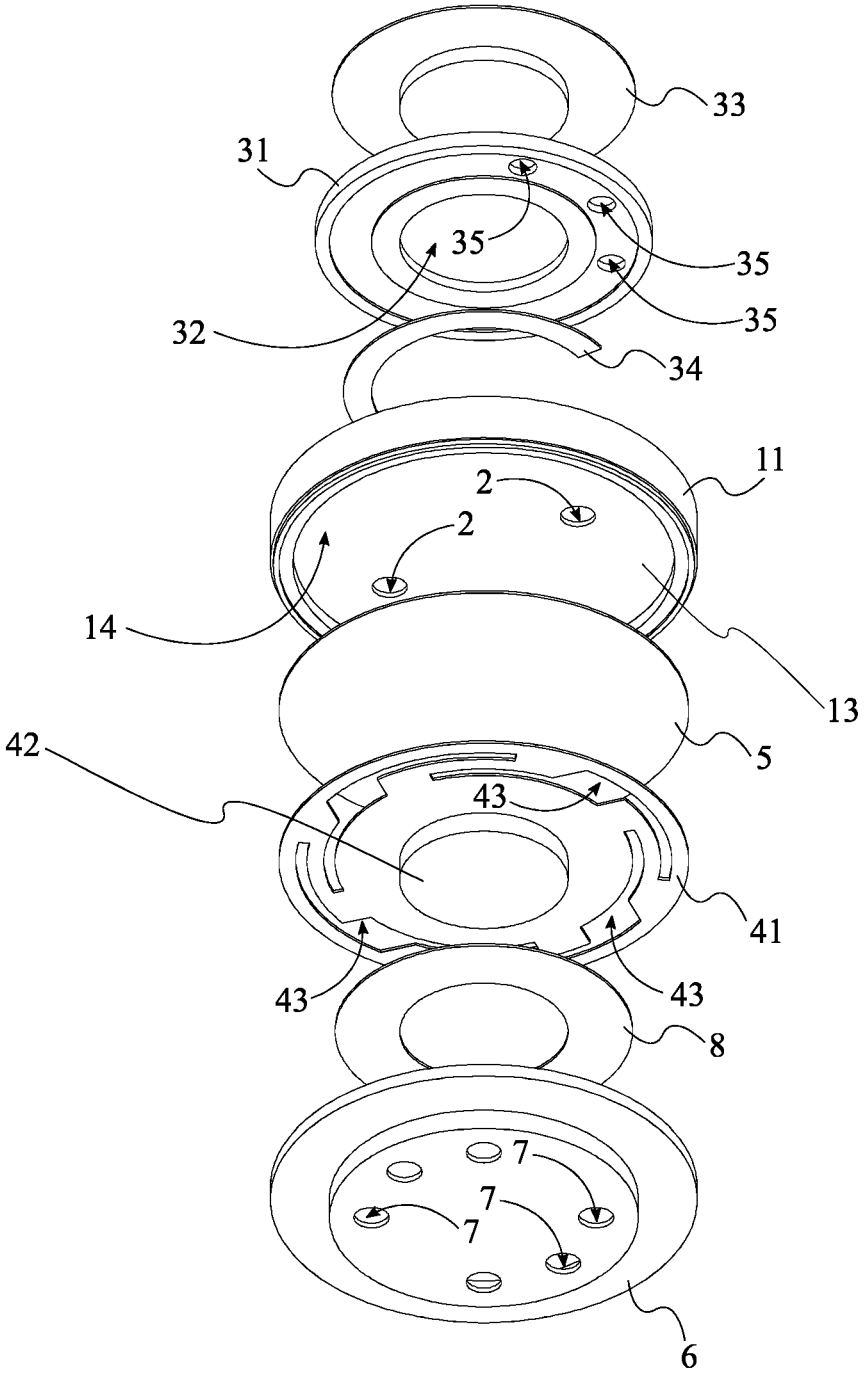
FIG. 5 is an exploded bottom perspective view of the present invention.

In reference to FIG. 1 and FIG. 5, as described above, the vibration unit 4 produces vibratory haptic feedback to augment the audio output of the acoustic driver 3. The primary dampening unit 5 is a device designed to attenuate any unwanted vibrations and air pressure force generated by the vibration unit 4. The primary dampening unit 5 is mounted in between the main cabinet 1 and the vibration unit 4. As a result, the primary dampening unit 5 prevents unwanted vibrations produced by the vibration unit 4 from distorting the audio output of the acoustic driver 3. Preferably, the primary dampening unit 5 acts as a one-way filter that enables desired vibrations and air pressure force output from the vibration unit 4 to travel through the main cabinet 1 toward the acoustic driver 3 while preventing the transmission of undesired vibrations and air pressure force. In the preferred embodiment of the present invention, the main cabinet 1 is mounted within each of a pair of headphones. Accordingly, the vibratory and acoustic output of the present invention is transferred directly into the user's ears. Thus, enhancing an immersive experience for the user wearing a pair of headphones that is equipped with the present invention.

In reference to FIG. 4 through FIG. 8, the present invention is designed to employ the plurality of main ventilation holes 2 to exhaust excess air pressure force generated by the acoustic driver 3 and the vibration unit 4. To facilitate this, the main cabinet 1 comprises a main body 11 and a speaker-receiving receptacle 12. The main body 11 is a structural component that retains the acoustic driver 3 and the vibration unit 4 in orientations that facilitate directing acoustic and vibratory output toward a desired position. The speaker-receiving receptacle 12 normally traverses into the main body 11 and the acoustic driver 3 is mounted within the speaker-receiving receptacle 12. As a result, the acoustic driver 3 is retained in an orientation that facilitates directing audio output toward a desired position. As described above, the plurality of main ventilation holes 2 acts as a filter that directs unwanted air pressure force and vibrations into the external environment. To facilitate this functionality, the present invention makes use of a plurality of main ventilation holes 2 that are oriented in a plurality of directions. In some embodiments, the plurality of main ventilation holes 2 laterally traverses through the main body 11 into the speaker-receiving receptacle 12. While in other embodiments, the plurality of main ventilation holes 2 normally traverses through the main body 11 into the speaker-receiving receptacle 12. Consequently, unwanted air pressure force can be exhausted from the main cabinet 1 at a plurality of advantageous locations, through the plurality of main ventilation holes 2. Further, the release of excess air pressure force enables a diaphragm of the acoustic driver 3 to oscillate freely without distortion caused by an excess of ambient air pressure force. Thereby, maximizing output fidelity and acoustic performance. The size and distribution the plurality of main ventilation holes 2 is determined by the intended use of the device and can be changed without departing from the scope or spirit of the present invention.

In reference to FIG. 4 through FIG. 8, as described above, the present invention is designed to improve user experience by augmenting the audio output of the acoustic driver 3 with haptic feedback from the vibration unit 4. To facilitate this, the present invention further comprises a vibration compartment 14 and a partition plate 13. The vibration compartment 14 is a vibration-enhancing chamber that facilitates vibrating the main cabinet 1 to produce the desired haptic feedback. Additionally, the vibration compartment 14 normally traverses into the main body 11, opposite to the speaker-receiving receptacle 12. The partition plate 13 is mounted in between the speaker-receiving receptacle 12 and the vibration compartment 14. Preferably, the plurality of main ventilation holes 2 traverses from the speaker-receiving receptacle 12, through the partition plate 13, and into the vibration compartment 14. Accordingly, the partition plate 13 acts as a partial barrier that prevents unwanted air pressure force from traveling between the speaker-receiving receptacle 12 and the vibration compartment 14. The vibration unit 4 is mounted within the vibration compartment 14 and is positioned offset from the partition plate 13, across the vibration compartment 14. Thus positioned, the vibration unit 4 directs vibrations into the vibration compartment 14, which acts as an amplifier of the vibratory output of the vibration unit 4. The primary dampening unit 5 is positioned in between the partition plate 13 and the vibration unit 4. As a result, the primary dampening unit 5 prevents unwanted vibrations from decreasing the audio fidelity of the present invention. Preferably, the primary dampening unit 5 is a disk of felt paper that is mounted adjacent to the partition plate 13 and acts as a one way filter that enables air pressure force to pass from the speaker-receiving receptacle 12 into the vibration compartment 14 without enabling air pressure force to travel in the opposite direction. In some embodiments, the primary dampening unit 5 includes a harness that is mounted in between the vibration unit 4 and the main cabinet 1, thereby minimizing the transmission of unwanted vibrations from the vibration unit 4 into the main cabinet 1.

Figure 4:
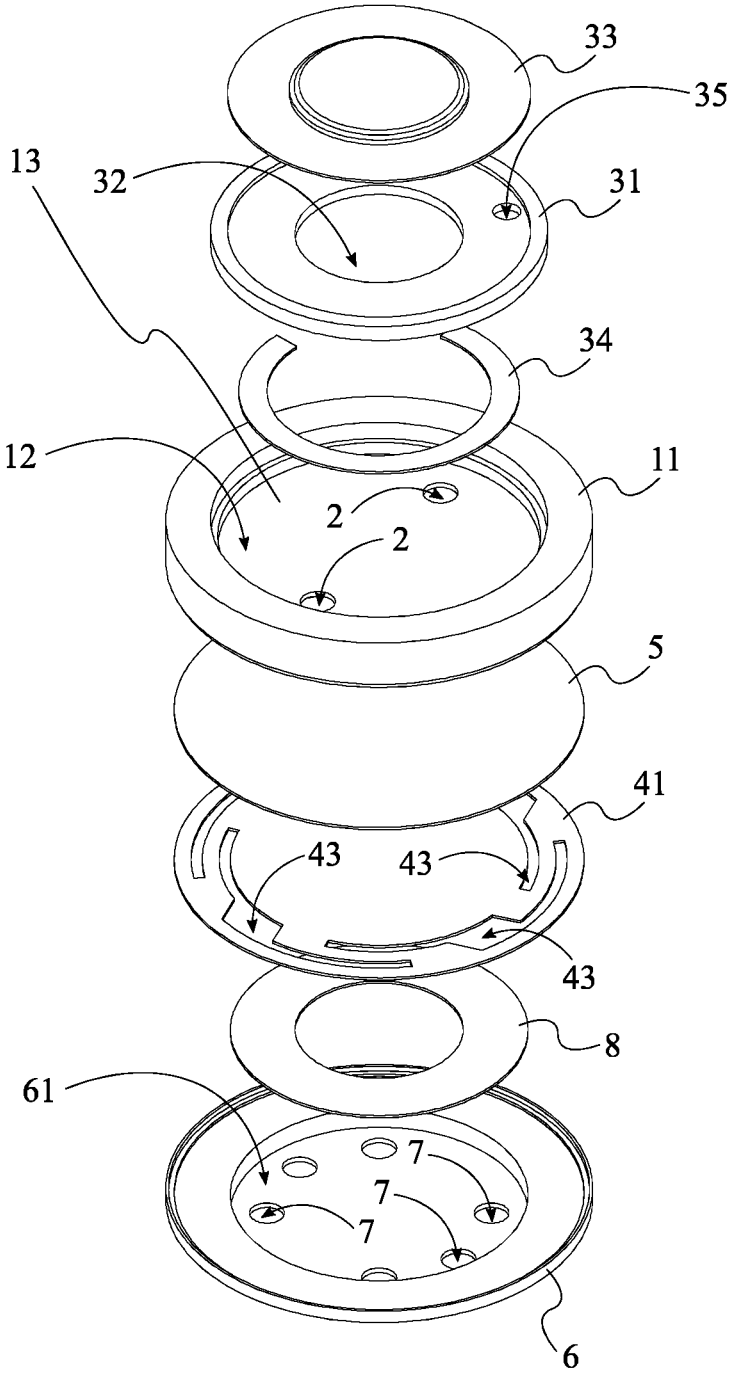
FIG. 4 is an exploded top perspective view of the present invention.
Figure 6:
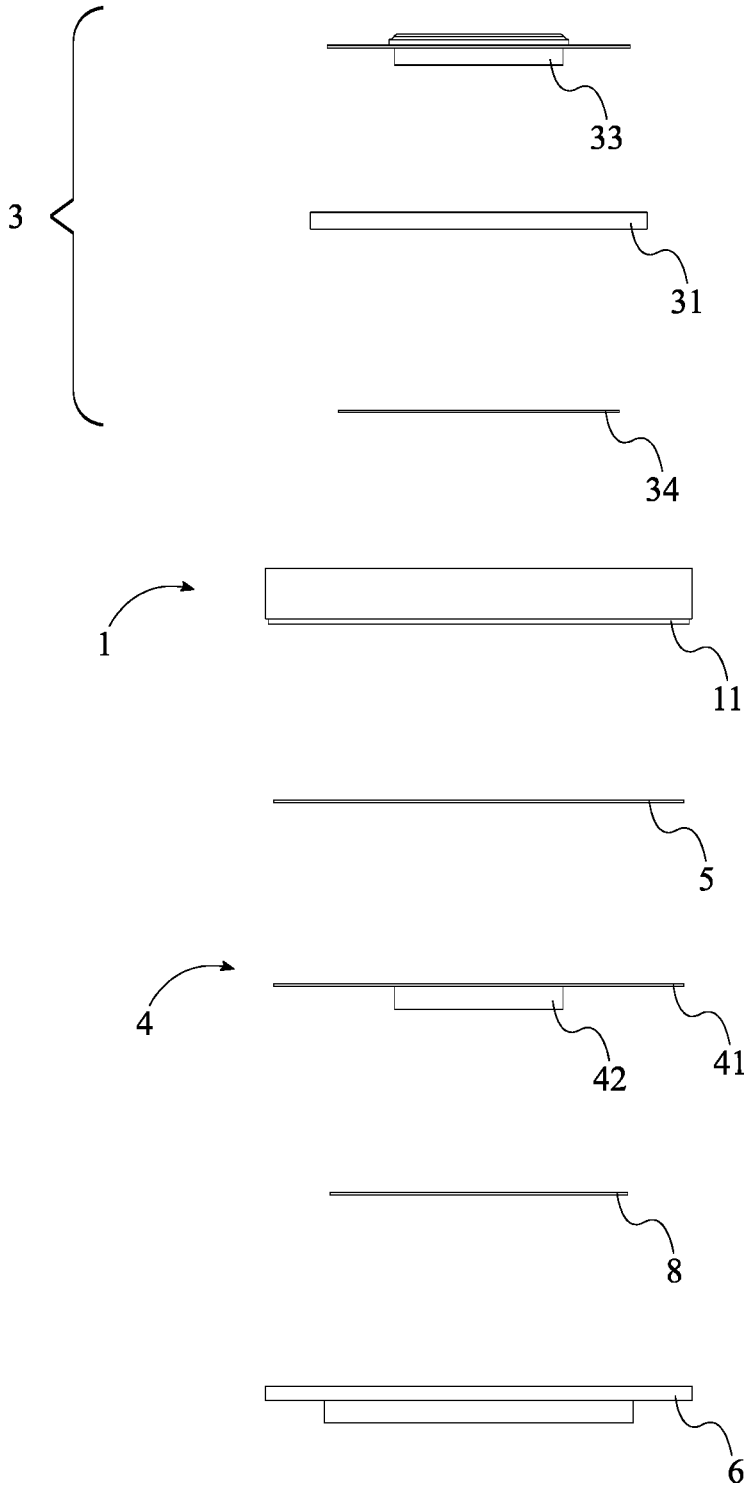
FIG. 6 is an exploded front view of the present invention.
Figure 7:
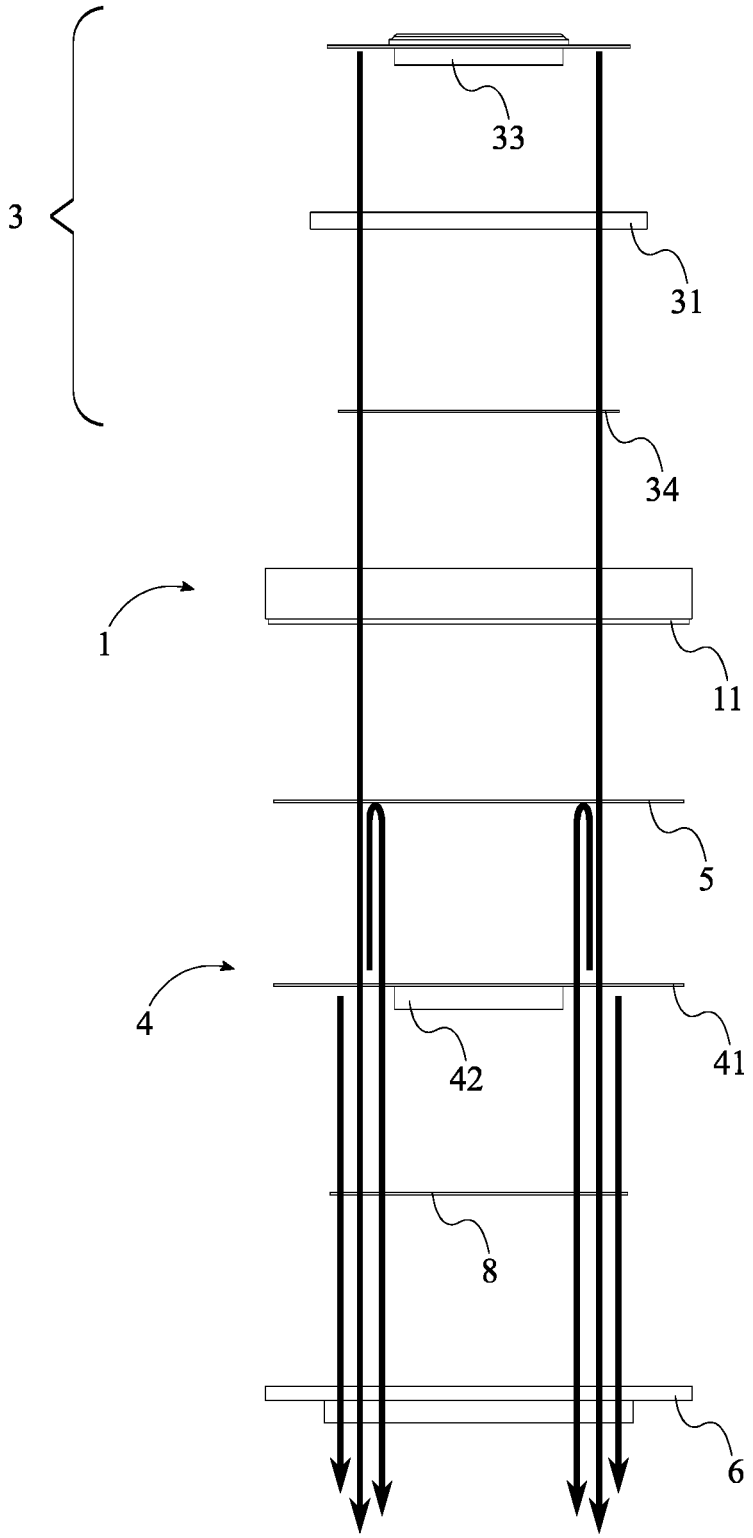
FIG. 7 is an exploded front view of the present invention. In this view, the bold arrows indicate the direction of air pressure force transmission though the present invention.
Figure 8:
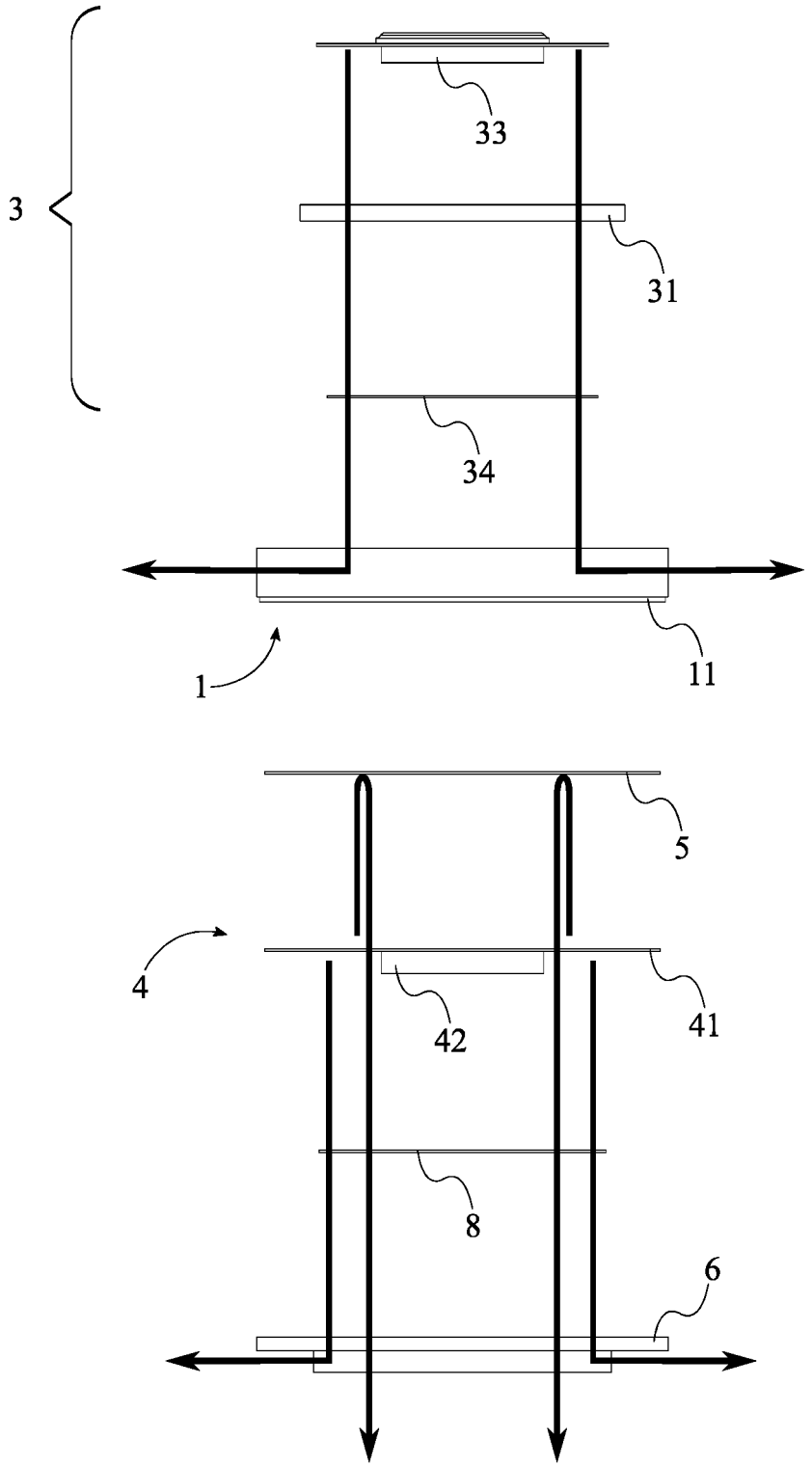
FIG. 8 an exploded front view of the present invention with ventilation holes laterally traversing through the main cabinet and the secondary cabinet. In this view, the bold arrows indicate the direction of air pressure force transmission though the present invention.

In reference to FIG. 4 and FIG. 6, the acoustic unit is designed to isolate an acoustic element from external vibrations. To that end, the acoustic driver 3 comprises a speaker housing 31, a speaker-receiving hole 32, a speaker unit 33, and a speaker dampening unit 34. The speaker-receiving hole 32 normally traverses through the speaker housing 31. Additionally, the speaker unit 33 is mounted within the speaker-receiving receptacle 12, and the speaker housing 31 is mounted in between the speaker unit 33 and the main housing. Thus, the speaker housing 31 retains the speaker unit 33 in an orientation that facilitates directing acoustic output toward a desired position. Preferably, the speaker dampening unit 34 is a piece of felt that is mounted in between the speaker housing 31 and the main cabinet 1. Thus, the speaker dampening unit 34 is able to attenuate any unwanted vibrations and air pressure force generated by the speaker unit 33. In some embodiments, the speaker dampening unit 34 includes a harness that is mounted in between the speaker housing 31 and the main cabinet 1, thereby minimizing the transmission of unwanted vibrations between the acoustic driver 3 and the main cabinet 1.

In reference to FIG. 4 and FIG. 5, the acoustic driver 3 further comprises a plurality of speaker ventilation holes 35 that normally traverse through the speaker housing 31. Preferably the plurality of speaker ventilation holes 35 is radially distributed around the speaker hole. Consequently, the plurality of speaker ventilation holes 35 enables evenly relieving the excess air pressure force generated by the speaker unit 33.

Figure 3:
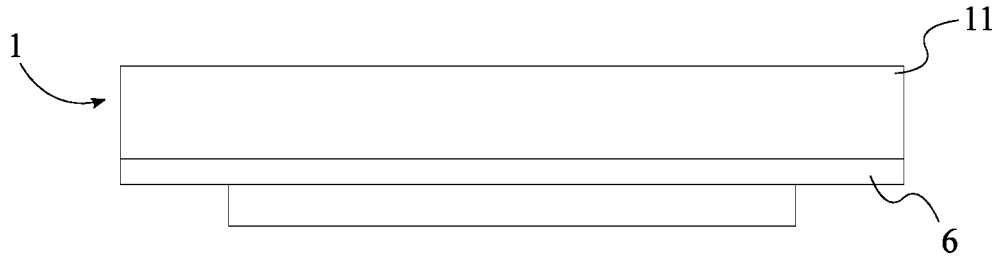
FIG. 3 is a front view of the present invention.

In reference to FIG. 3 and FIG. 5, as described above, the vibration unit 4 enables the present invention to output vibration-based haptic feedback. To facilitate this, the vibration unit 4 comprises a vibration sheet 41, a vibrating component 42, and a plurality of vibrator ventilation holes 43. The vibration sheet 41 is a semi rigid sheet of material designed to amplify and distribute vibrations. The vibrating component 42 is preferably an electric motor or buzzer. The vibration sheet 41 is mounted adjacent to the main cabinet 1. Additionally, the vibrating component 42 is mounted adjacent to the vibration sheet 41, opposite to the main cabinet 1. Further, the vibration sheet 41 is mounted within the vibration compartment 14. Thus positioned, vibrations that are generated by the vibrating component 42 are amplified by the vibration sheet 41 and then transferred to the main cabinet 1. The plurality of vibrator ventilation holes 43 normally traverses through the vibration sheet 41. Thus, minimizing the excess air pressure force generated by oscillating the vibration sheet 41.

In reference to FIG. 4 through FIG. 6, the preferred embodiment of the present invention is designed as a self-contained device that isolates the internal components from hazards in the external environment. To facilitate this functionality, the present invention further comprises a secondary cabinet 6, a vibrator-receiving receptacle 61, and a plurality of secondary ventilation holes 43. The secondary cabinet 6 is a structural enclosure for the vibration unit 4. Additionally, the vibrator-receiving receptacle 61 normally traverses into the secondary cabinet 6 and the vibration unit 4 is mounted within the vibrator-receiving receptacle 61. Further, the secondary cabinet 6 is mounted adjacent to the main cabinet 1. Thus, the secondary cabinet 6 and the main cabinet 1 work in concert to create an enclosure for the acoustic driver 3 and the vibration unit 4. The plurality of secondary ventilation holes 43 traverses through the secondary cabinet 6 into the vibrator-receiving receptacle 61. Thus, forming exhaust vents for excess air pressure force within the main cabinet 1 and secondary cabinet 6. In some embodiments the plurality of secondary ventilation holes 43 laterally traverses through the secondary cabinet 6 into the vibrator-receiving receptacle 61. While in other embodiments, the plurality of secondary ventilation holes 43 normally traverses through the secondary cabinet 6 into the vibrator-receiving receptacle 61. Consequently, unwanted air pressure force can be exhausted from the secondary cabinet 6 at a plurality of advantageous locations, through the plurality of secondary ventilation holes 43. In the preferred embodiment of the present invention, the plurality of speaker ventilation holes 35, the plurality of main ventilation holes 2, the plurality of vibrator ventilation holes 43, and the plurality of secondary ventilation holes are aligned to form a pathway for excess vibrations and air pressure force to be exhausted from within the main cabinet 1 and the secondary cabinet 6 into the external environment.

In reference to FIG. 4 and FIG. 5, the present invention further comprises a secondary dampening unit 8 that functions similarly to the primary dampening unit 5. The secondary dampening unit 8, however, is mounted within the vibrator-receiving receptacle 61 and is positioned in between the vibration unit 4 and the secondary cabinet 6. Thus positioned, the secondary dampening unit 8 is able to further minimize unwanted vibrations and prevent air pressure force in the external environments from distorting the audio or vibratory output of the present invention. In some embodiments, the secondary dampening unit 8 includes a harness that is mounted in between the vibration unit 4 and the secondary cabinet 6, thereby minimizing the transmission of unwanted vibrations from the vibration unit 4 into the secondary cabinet 6.

Although the invention has been explained in relation to its preferred embodiment, it is to be understood that many other possible modifications and variations can be made without departing from the spirit and scope of the invention as hereinafter claimed.

What is claimed is:

1. A speaker with an integrated air pressure and vibration mitigation system comprising:

a main cabinet;

a plurality of main ventilation holes;

at least one acoustic driver;

at least one vibration unit;

at least one primary dampening unit;

the plurality of main ventilation holes traversing through the main cabinet;

the acoustic driver being mounted adjacent to the main cabinet;

the vibration unit being mounted adjacent to the main cabinet, opposite to the acoustic driver;

the primary dampening unit being mounted in between the main cabinet and the vibration unit;

a secondary cabinet;

a vibrator-receiving receptacle;

a plurality of secondary ventilation holes;

the vibrator-receiving receptacle normally traversing into the secondary cabinet;

the plurality of secondary ventilation holes traversing through the secondary cabinet into the vibrator-receiving receptacle;

the vibration unit being mounted within the vibrator-receiving receptacle; and the secondary cabinet being mounted adjacent to the main cabinet.

2. The speaker with an integrated air pressure and vibration mitigation system as claimed in claim 1 comprising:

the main cabinet comprising a main body and a speaker-receiving receptacle;

the speaker-receiving receptacle normally traversing into the main body;

the acoustic driver being mounted within the speaker-receiving receptacle;

the plurality of main ventilation holes traversing through the main body into the speaker-receiving receptacle.

3. The speaker with an integrated air pressure and vibration mitigation system as claimed in claim 2 comprising:

the plurality of main ventilation holes laterally traversing through the main body into the speaker-receiving receptacle.

4. The speaker with an integrated air pressure and vibration mitigation system as claimed in claim 2 comprising:

the plurality of main ventilation holes normally traversing through the main body into the speaker-receiving receptacle.

5. The speaker with an integrated air pressure and vibration mitigation system as claimed in claim 2 comprising:

the main cabinet further comprising a vibration compartment and a partition plate;

the vibration compartment normally traversing into the main body, opposite to the speaker-receiving receptacle;

the partition plate being mounted in between the speaker-receiving receptacle and the vibration compartment;

the vibration unit being mounted within the vibration compartment;

the vibration unit being positioned offset from the partition plate across the vibration compartment;

the primary dampening unit being positioned in between the partition plate and the vibration unit.

6. The speaker with an integrated air pressure and vibration mitigation system as claimed in claim 1 comprising:

the acoustic driver comprising a speaker housing, a speaker-receiving hole, and a speaker unit;

the speaker-receiving hole normally traversing through the speaker housing;

the speaker unit being mounted within the speaker-receiving receptacle;

the speaker housing being mounted in between the speaker unit and the main cabinet.

7. The speaker with an integrated air pressure and vibration mitigation system as claimed in claim 6 comprising:

the acoustic driver further comprising a speaker dampening unit;

the speaker dampening unit being mounted in between the speaker housing and the main cabinet.

8. The speaker with an integrated air pressure and vibration mitigation system as claimed in claim 6 comprising:

the acoustic driver further comprising a plurality of speaker ventilation holes;

the plurality of speaker ventilation holes normally traversing through the speaker housing.

9. The speaker with an integrated air pressure and vibration mitigation system as claimed in claim 1 comprising:

the vibration unit comprising a vibration sheet, a vibrating component, and a plurality of vibrator ventilation holes;

the vibration sheet being mounted adjacent to the main cabinet;

the vibrating component being mounted adjacent to the vibration sheet, opposite to the main cabinet;

the plurality of vibrator ventilation holes normally traversing through the vibration sheet.

10. The speaker with an integrated air pressure and vibration mitigation system as claimed in claim 1 comprising:

a secondary dampening unit;

the secondary dampening unit being mounted within the vibrator-receiving receptacle;

the secondary dampening unit being positioned in between the vibration unit and the secondary cabinet.

11. The speaker with an integrated air pressure and vibration mitigation system as claimed in claim 1 comprising:

the plurality of secondary ventilation holes laterally traversing through the secondary body into the vibrator-receiving receptacle.

12. The speaker with an integrated air pressure and vibration mitigation system as claimed in claim 1 comprising:

the plurality of secondary ventilation holes normally traversing through the secondary body into the vibrator-receiving receptacle.

13. The speaker with an integrated air pressure and vibration mitigation system as claimed in claim 1 wherein the primary dampening unit being a disk of felt paper.

* * * * *